US005248044A

United States Patent [19]

Szilvasi

[11] Patent Number: 5,248,044

[45] Date of Patent: Sep. 28, 1993

[54] SCREEN FITTING AND AUTOMATIC TENSIONING OF SUSPENDED AND PIVOTING TYPE SYSTEM

[76] Inventor: Peter Szilvasi, 12 rue Emile Georget, 86100 Chatellerault, France

[21] Appl. No.: 935,010

[22] Filed: Aug. 25, 1992

[30] Foreign Application Priority Data

Aug. 26, 1991 [FR] France ..... 91 10661

[51] Int. Cl.[5] ..... B07B 1/49

[52] U.S. Cl. ..... 209/411; 209/415

[58] Field of Search ..... 209/403, 411, 415, 409, 209/414, 416, 417

[56] References Cited

U.S. PATENT DOCUMENTS 2,579,002 12/1951 Johnson ..... 209/415

3,254,428 6/1966 Bates ..... 209/415

FOREIGN PATENT DOCUMENTS 839609 6/1981 U.S.S.R. ..... 209/411

*Primary Examiner*—Robert P. Olszewski

*Assistant Examiner*—Kenneth Noland

*Attorney, Agent, or Firm*—Bachman & LaPointe

[57] ABSTRACT

My invention concerns the design and realization, for vibrating or shaking screening machines, of a screen fitting and automatic tensioning of suspended and pivoting type system. The aim of my invention is to reduce the necessary fatigue and time occasioned for changing screen mats, cloths or others in vibrating or shaking machines, to carry out the said changings without or with the least possible intervention inside of such machines. Also to obtain a system in which the tension bars, serving to receive the screen mats, cloths or other tension hooks, as well as to apply a tension over the said screen mats, cloths or others, such tension bars are maintained in a suspended, pivoting and definite position to allow for one the simple sliding of the screen mats, cloths or others into the vibrating or shaking machine, and finally to tension them from the outside of the said machine. My invention avoids as well the clamping of the tension hooks over the camber frame of any vibrating or shaking machine, resulting the free pivoting of the tension bars, consequently the natural elongation, after a few hours or days of use of the screen mats, cloths or others will be taken up automatically.

8 Claims, 2 Drawing Sheets

SCREEN FITTING AND AUTOMATIC TENSIONING OF SUSPENDED AND PIVOTING TYPE SYSTEM

BACKGROUND OF THE INVENTION

In the present state of art, the fitting and tensioning of screen mats, cloth or others when used in vibrating or shaking machines, not only the whole crushing-screening plant must be stopped, but it is also necessary to enter inside the vibrating or shaking machine for the removal of used or damaged and then the fitting and tensioning of new screen mats, cloths or others, as well as to put back all the fitting and tensioning elements that include the tension bars, bolts, nuts and counter nuts, etc.

One must note, that in most cases, vibrating or shaking machines are made with several decks comprising several screen mats, cloths or others per deck and that the space between decks is very limited.

The change of screen mats, cloths or others is rather long, tiresome and costly in terms of loss of production and immobilization of labor. When fitting or removing new or used screen mats, cloths, or others, the presence of a person is indispensable inside the vibrating or shaking machine for at least to remove and replace the tension bars from and into the tension hooks, to remove and replace through the holes in the tension bars and in the flanges of the vibrating or shaking machine the tension bolts, to maintain these elements while from the outside of the vibrating or shaking machine, one or several persons will screw the nuts and counter nuts onto the tension bolts.

Vibrating or shaking machines currently used in mines, quarries, sand and gravel pits, etc., are not provided with systems that will avoid the inconveniences above mentioned. In all cases, the tension bars and bolts fall into the vibrating or shaking machine, when refitted, tension hooks are clamped onto the camber frame for one by the proper weight of the tension bars,and because of the pull and tension angle of the tension bolts and the pressure exercised on them at the moment of tensioning the screen mats, cloths or others.

The correct tensioning is equally not assured because of the clamping of the tension hooks over the camber frame, thus resulting a rigid fitting and tensioning without the possibility of taking up the natural lengthening of the screen mats, cloths, or others after a few hours or days of functioning. It is then necessary to stop the installation from time to time to retighten the screen mats, cloths or others.

SUMMARY OF THE INVENTION

In accordance with the present invention, the present invention resides in a system of fitting screen mats, cloths or others in a flexible and suspended manner with automatic tensioning, characterized in that the tension bars are maintained hooked and suspended via the suspension and pivot rods, welded onto the said tension bars, in the suspension channels that are welded or otherwise fastened onto the vibrating or shaking machine's flanges, in that the automatic and flexible tensioning system is held suspended and pivoting freely around the pivot rods that are hooked into the suspension channels, in that the permanent and flexible tension of the screen mats, cloths or others is assured through the automatic compression and decompression of the elastomeric tension rings, in that the suspension channels are welded or otherwise fastened onto the vibrating or shaking machine's flanges in such a way that a clearance of minimum 4–5 mm is maintained permanently to avoid the clamping of the tension hooks on the camber frame of the vibrating or shaking machine, in that each tension bar is provided with at least two cut outs or openings in its upper part to allow the free passage of the suspension channels, in that over each cut out or opening a pivot and suspension rod is welded, in that the edge angle (A1–A2) is diminished in a permanent and definite way to a highest possible level by the predetermined position of the hook-up and suspension channels for a better spread of the materials to be screened, in that the rubber strip protects against wear the tension bars, the tension bolt heads, avoids the filling-in of the tension hooks in the empty space as well as the "water channel" in case of wet screening.

BRIEF DESCRIPTION OF THE DRAWINGS

The present invention will be more readily understood from a consideration of the attached drawings in which.

DETAILED DESCRIPTION

Figure 1:
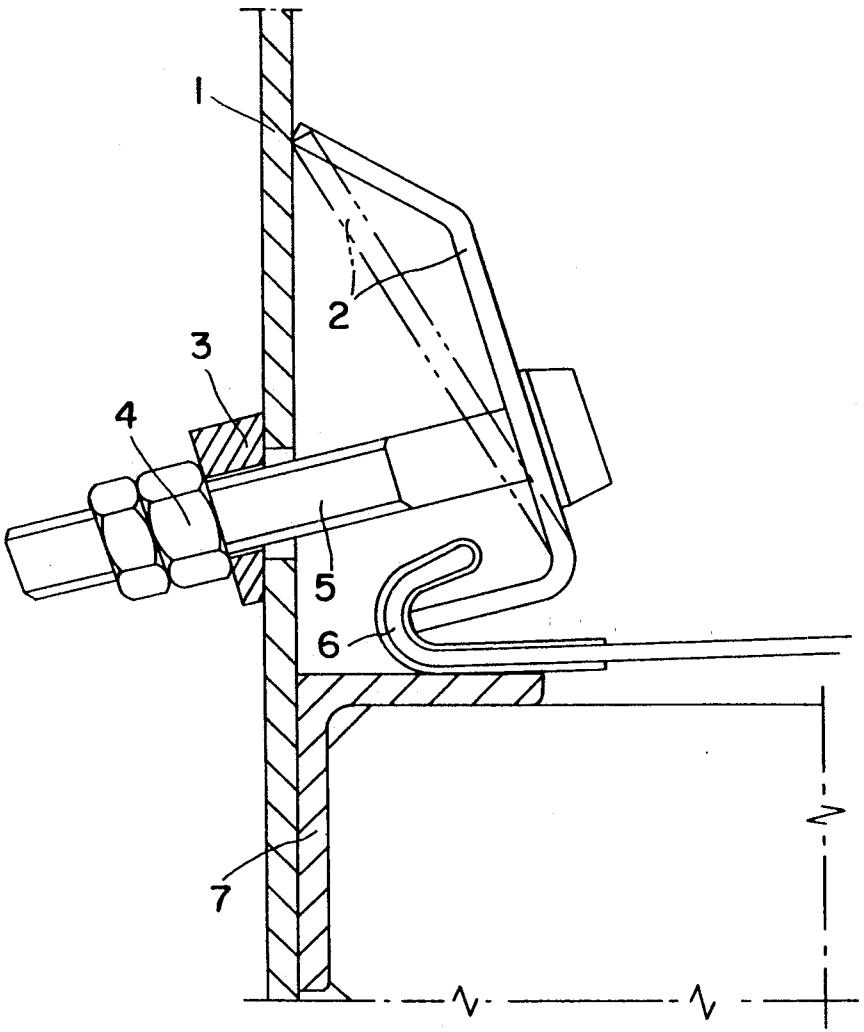

A rigid fitting and tensioning is illustrated by FIG. 1.

Figure 2:
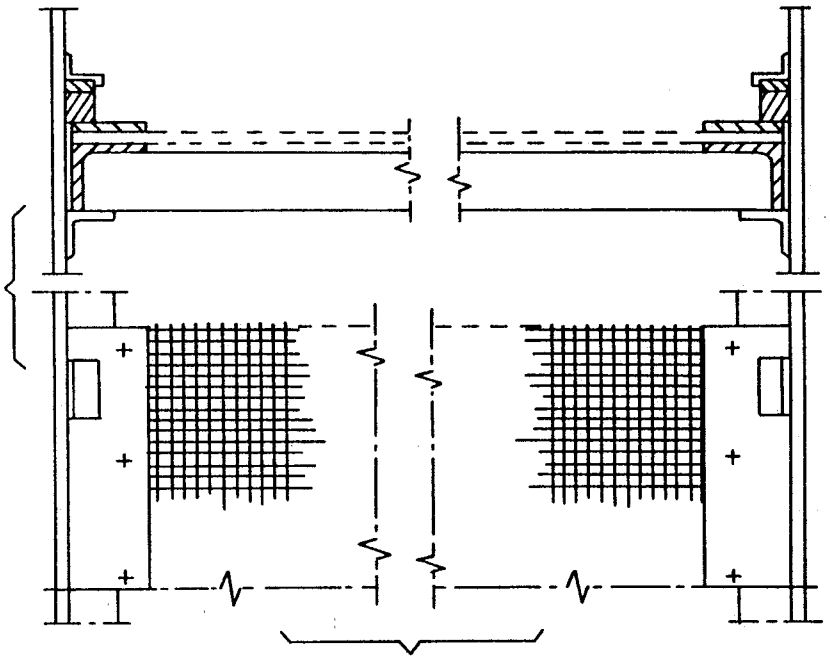
FIGS. 1 and 2 represent prior art fittings.

In the most primitive way of fitting screen mats, cloths or others without tension hooks are simply bolted onto a frame of steel angles or wood frame, then placed over the vibrating or shaking machine's subframe and clamped with tapered wood keys or wedges, such a case is illustrated by FIG. 2.

Although some solutions have been found and patented, among others like Trelleborg AB—No. 0 081 471 for molded synthetic panels without tension hooks, the clamping of panels into subframes by inflated rubber hoses as per Thule United Ltd. No. 218315, the same system by Flow Control Service B.V.—No. 0 185 409, conventional fitting systems without the suspension and pivoting rod the tension bars and the automatic tensioning of screen panels, cloths, or others as per the following patents: U.S. Pat. Nos. 2,199,596, 2,985,303, 2,190,993, German Patent Nos. 1.940.889, 2.316.653, none of these patents offer a valuable solution to the above enumerated problems with the exception of my French Patent No. 2.631.255, entitled: Removable cassette or cartridge type screen frames.

Figure 3:
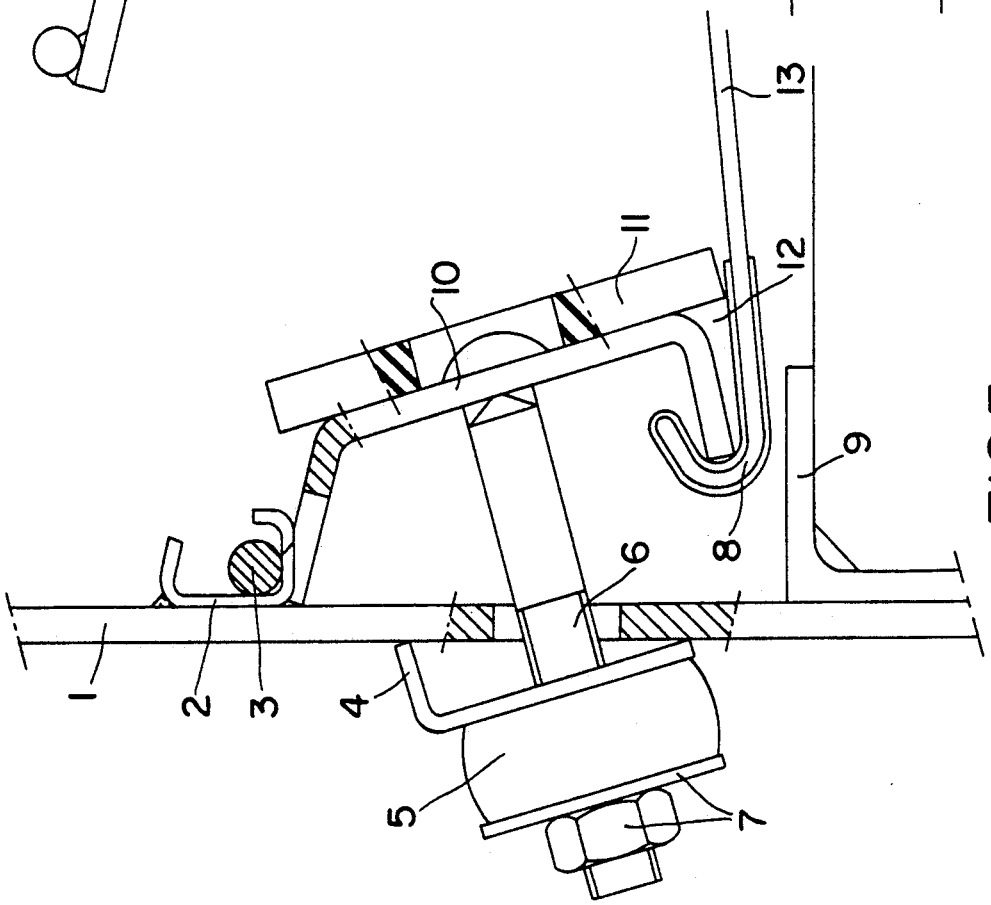
FIG. 3 is a side view of the fitting of the present invention.

In this patent, all the elements making up my invention are shown in FIG. 3.

My invention concerns the design and realization of a system for fitting screen mats, cloths and others, used in screening and classifying, system in which the fitting is flexible, suspended and the tensioning of the screen mats, cloths and others is automatic.

Indeed and according to Detail M1 (FIG. 3), the main element of any system for fitting of screen mats, cloths or others (13), namely the tension bar (10) is suspended over at least two pivoting rods (3), which rods are hooked up into the suspension channels (2) for one to avoid the fall of the tension bar (10) and also that the tension hooks (8) be clamped onto the vibrating or shaking machine's camber frame (9).

The suspension channels (2), either welded or otherwise fastened onto the vibrating or shaking machine's flanges (1), assure that once the tension bars (10) with their welded pivot rods (3) are hooked up into the suspension channels (2) and the tension hooks (8) of the screen mats, cloths or others (13) are slided over the tension bars (10), there is a gap of minimum 4–5 mm to avoid the clamping of the tension hooks (8) over the vibrating or shaking machine's camber frame (9) and allow the free pivoting of the tension bars (10).

Figure 5:
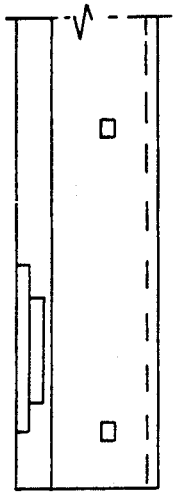
FIG. 5 is a detailed view of the tension bar.
Figure 4:
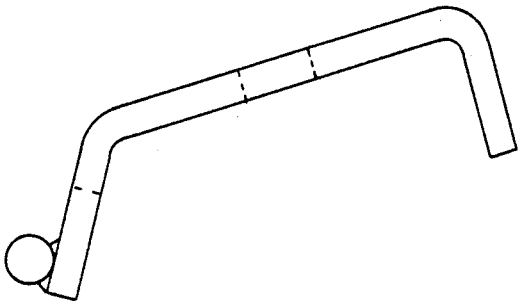
FIG. 4 is a detailed view side view of the tension bar.
Figure 6:
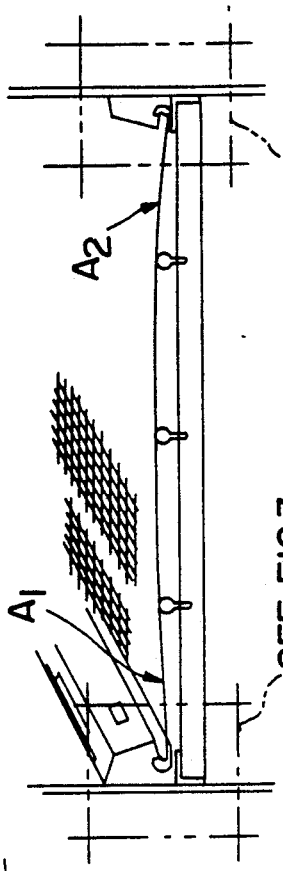
FIG. 6 is a detailed view of the fitted screen.

The tension bars (10) are provided at least with two cut outs or openings in their upper part as shown in FIG. 5 over a length of minimum 5 mm more than the length of the suspension channels (2) in order to facilitate the free passage of the said suspension channels (2) in the cut outs or openings in the tension bars (10). Over the cut outs or openings are welded the pivot rods (7) in lengths that will overlap, on each side,the cut outs or openings by at least 25 mm to obtain an adequate weld as shown in FIGS. 4 and 5.

The tension of the screen mats, cloths or others (13) is assured by the components as illustrated through the items 4–5–6–7 as per FIG. 3. In general, the tension bolts (6) are placed at an angle in the vibrating or shaking machine, reason for the use of a profile (4), thus the role of it is to compensate such an angle to exercise a parallel and correct pulling in relation to the tension bar (10).

The tension bolts (6) are generally of round head-square neck type which are placed into the corresponding holes of the tension bars (10) and passed through the holes originally made in the flanges (1) of the vibrating or shaking machine. The role of these bolts (6), washers/nuts (7) is to tension the screen mats, cloths or others (13) via the tension hooks (8).

As for the fit and tension rings (5), their role is to assure the permanent tensioning of the screen mats, cloths or others (13) simply by the compression and decompression automatic of these elastomeric rings (5), eventually compression springs or tapered washer rings of Belleville type.

The suspension channels (2) are placed in such a manner on the vibrating or shaking machine's flanges (1), that the edge angle A1–A2 (often too important) is corrected as much as possible so as to avoid that the flow of materials to be screened is not mainly spread on the sides of the screen mats, cloths or others (13), the dimishing of the edge angle (A1–12) results a better distribution over the screening area. The correction of the edge angle (A1–A2) is immutable and reproducible at each screen mat, cloth or other fittings.

Tension bars (10) as well as the tension bolt (6) heads are protected against wear by the rubber strips (11) that will also avoid the filling-in of the gap (12) in the tension hooks (8) and the "water channel" (12) in the said hooks (8).

What is claimed is:

1. A system of fitting screen mats, cloths or others in a flexible and suspended manner with automatic tensioning, wherein tension bars are maintained hooked and suspended via suspension and pivot rods, welded onto said tension bars, in suspension channels that are welded or otherwise fastened onto a vibrating or shaking machine's flanges, wherein an automatic and flexible tensioning system is held suspended and pivoting freely around the pivot rods that are hooked into the suspension channels, and wherein permanent and flexible tension of the screen mats, cloths or others is assured through automatic compression and decompression of elastomeric tension rings, wherein the suspension channels are welded or otherwise fastened onto the vibrating or shaking machine's flanges in such a way that a clearance of minimum 4–5 mm is maintained permanently to avoid clamping of tension hooks on a camber frame of the vibrating or shaking machine, with each tension bar provided with at least two cut outs or openings in its upper part to allow the free passage of the suspension channels, wherein over each cut out or opening a pivot and suspension rod is welded, wherein an edge angel (A1–A2) is diminished in a permanent and definite way to a highest possible level by a predetermined position of hook-up and suspension channels for a better spread of the materials to be screened, wherein a rubber strip protects against wear the tension bars and tension bolt heads, and avoids filling-in of the tension hooks in an empty space as well as a water channel in case of wet screening.

2. A system of fitting as per claim 1, in that the suspension channels are welded or otherwise fastened onto the vibrating or shaking machine's flanges so as to avoid the clamping of the tension hooks onto the vibrating or shaking machine's camber frame, rendering such fitting system free to all movements in a definite fashion.

3. A system of fitting as per claim 1, in that the tension bars are provided with at least two cut outs or openings in their upper part to allow the free passage of the suspension channels over which pivot and suspension rods are welded.

4. A system of fitting as per claim 1, in that the suspension and pivot rods welded onto the tension bars allow the easy and simple hooking of the said tension bars into the suspension channels in a definite, reproducible, pivoting and held position.

5. A fitting system as per claim 1, in that the combination of the pivot rods welded onto the tension bars, and the suspension channels welded or otherwise fastened onto the flanges of the vibrating or shaking machine eliminates all interventions inside the vibrating or shaking machine when changing screen mats, cloths or others, they are simply slided in over the suspended tension bars via the tension hooks.

6. A system of fitting as per claim 1, in that the flexible and automatic tensioning assures the permanent tensioning of the screen mats, cloths or others by the automatic compression and decompression of the elastomeric tension rings or eventually compression springs or Belleville type tapered spring washers.

7. A system of fitting as per claim 1, in that the position of the suspension channels allows to correct the edge angle, and to obtain a better spread of the materials to be screened over the screening area.

8. A system of fitting as per claim 1, in that a pulling and tensioning angle of the tension bolts is compensated by a steel angle so that the pulling and tensioning is parallel to the tension bars.

* * * * *